United States Patent [19]

Schmidt

[11] 3,936,695

[45] Feb. 3, 1976

[54] ELECTRON COLLECTOR HAVING MEANS FOR TRAPPING SECONDARY ELECTRONS IN A LINEAR BEAM MICROWAVE TUBE

[75] Inventor: Robert C. Schmidt, Woodside, Calif.

[73] Assignee: Varian Associates, Palo Alto, Calif.

[22] Filed: Apr. 26, 1974

[21] Appl. No.: 464,420

[52] U.S. Cl. ..... 315/3.5; 315/5.38

[51] Int. Cl.[2] ..... H01J 25/34

[58] Field of Search ..... 315/3.5, 5.38, 39.3

[56] References Cited

UNITED STATES PATENTS

| | | | |
|---|---|---|---|
| 3,585,429 | 6/1971 | O'Loughlin et al. | 315/5.38 |
| 3,644,778 | 2/1972 | Mihran et al. | 315/5.38 |
| 3,702,951 | 11/1972 | Kosmahl | 315/5.38 |
| 3,717,787 | 2/1973 | Doyle | 315/5.38 |
| 3,806,755 | 4/1974 | Lien et al. | 315/5.38 |

FOREIGN PATENTS OR APPLICATIONS

| | | | |
|---|---|---|---|
| 819,682 | 9/1959 | United Kingdom | 315/5.38 |

OTHER PUBLICATIONS

"The Tilted Electric Field Soft-Landing Collector and its Application to a TWT," by Matsuki et al., IEEE Transactions on Electron Devices, Vol. ED-19, No. 1, January 1972.

*Primary Examiner*—Saxfield Chatmon, Jr.
*Attorney, Agent, or Firm*—Stanley Z. Cole; R. K. Stoddard; R. B. Nelson

[57] ABSTRACT

The collector wall axially coextensive with the expanding beam of electrons includes at least portions thereof which extend inwardly to closely approach the periphery of the beam of electrons at several axially spaced planes. In its simplest form this structure consists of a series of annular baffle plates each having a central aperture of a diameter only slightly larger than the diameter of the beam at the axial plane in the collector where the baffle plate is located. These baffle plates have been found to substantially reduce the number of secondary (impact-produced) electrons which return from the collector to the interaction sections of the linear beam microwave tube. As a result spurious signals and noise caused by back-streaming secondary electrons are significantly reduced.

5 Claims, 2 Drawing Figures

ELECTRON COLLECTOR HAVING MEANS FOR TRAPPING SECONDARY ELECTRONS IN A LINEAR BEAM MICROWAVE TUBE

BACKGROUND OF THE INVENTION

Prior art linear-beam microwave tubes in UHF television transmitters operating in the frequency range from 450 MHz to 900 MHz have suffered from spurious signals and oscillation caused by secondary electrons back-streaming from the collector of the tube and returning through the tube in a direction reverse to that of the primary beam of electrons. These secondary electrons have been sufficiently numerous to cause (1) an increase in the observed noise level at the output of the tube, (2) ringing on heavy pulse signals and (3) oscillation. The secondary electrons are formed by impact of the high energy electron beam in the collector region. High energy secondary electrons having approximately the same emission velocity as the primary or beam electrons result from so-called "elastic" collisions. While these high energy secondary electrons are particularly troublesome, low energy secondary electrons are also emitted and can disturb normal tube operation. The secondary electrons can follow the beam path in a direction reverse to that of the beam and reach the input end of the tube where they are subjected to the high overall gain of the tube resulting in the aforementioned oscillation or ringing.

DESCRIPTION OF THE PRIOR ART

Several approaches were known in the prior art for controlling the emission of secondary electrons or for minimizing the deleterious effects of any secondary electrons emitted.

It has been well-known for many years that the ratio of high energy secondary electrons emitted from the surface of a body of material bombarded by a given beam of primary electrons is a directly increasing function of the atomic number of the material. Accordingly, the use of coating material having a lower atomic number than the substrate on which they are supported has been common. Of these materials, carbon suspended in a vehicle consisting of a binder dissolved in a solvent has been widely used. Unfortunately both the carbon and the readily available binders have a tendency to contaminate the desired high vacuum atmosphere within a tube. I.e., the binders tend to decompose slowly, evolving gases, while the carbon itself has a well-known ability to adsorb various gases which are released slowly.

Other approaches which have been used include simple enlargement of the collector such that the impact surface thereof is located at a relatively large distance from the entrance to the collector. This approach does reduce the probability of return of secondary electrons from the impact surface through the constricted entrance portion into the interaction section of the tube. Unfortunately, the resulting collector designs were often inconveniently large and cumbersome.

According to an alternative approach outlined in U.S. patent application Ser. No. 258,305, filed May 31, 1972 by Erling L. Lien and Martin E. Levin and assigned to the same assignee as the present invention now U.S. Pat. No. 3,806,755 issued Apr. 23, 1974, only the drownstream or back wall of the collector is enlarged while the remaining portion of the collector has a tapered shape conforming roughly to that of the expanding primary beam in the collector. Using this approach the back wall of the collector forms an impact surface portion dimensioned large enough to receive the entire primary beam of electrons. Accordingly the entire primary beam of electrons strikes that portion of the collector which is farthest from the constricted entrance portion of the upstream end of the collector. The probability of secondary electrons returning to the interaction section of the tube is thus reduced.

Furthermore the impact surface portion of the collector can have a shape approximating a portion of a sphere having its center at the entrance to the collector. Accordingly all secondary electrons will be generated at approximately the same distance from the entrance to the collector and will, therefore, have approximately the same low probability of returning to the tube.

This advantage becomes very important when the tube is heavily modulated, since the prior art designs such heavy modulation caused sufficient beam spreading in the collector region to produce impact of primary electrons well up on the side wall of the collector. Under these circumstances the resulting secondary electrons, being generated significantly closer to the entrance to the collector than is the case for secondaries generated near the back wall of the collector, have a much higher probability of returning to the interaction section of the tube.

SUMMARY OF THE INVENTION

According to the present invention the number of secondary electrons which can return from the collector to the interaction section of the tube can be substantially reduced by providing within the collector, at a plurality of axially spaced positions, portions of the inner wall of the collector which extend radially inwardly to closely surround the expanding beam of primary electrons. These inwardly extending wall portions together define a beam tunnel which has approximately the same diameter as the beam of primary electrons. These baffles produce the surprising result that the number of secondary electrons returning to the interaction section of the tube is significantly reduced.

OBJECTS

The principal object of the present invention is to provide an improved linear beam microwave tube in which the number of secondary electrons returning from the collector region to the interaction region of the tube is significantly reduced.

A further object is to provide a tube according to the first object in which the wall of the collector axially coextensive with the beam includes axially spaced, inwardly extending portions which define an electron beam tunnel having a cross section which increases in the downstream direction of the tube.

A further object is to provide a tube according to the preceding objects wherein the beam tunnel is formed by a plurality of axially spaced, radially inwardly extending baffle plates, each of which has a central aperture corresponding to the diameter of the electron beam in the collector.

These and other objects, features and advantages of the present invention will become more apparent upon reading the following detailed description and examining the accompanying drawings.

DETAILED DESCRIPTION OF THE INVENTION

Figure 1:
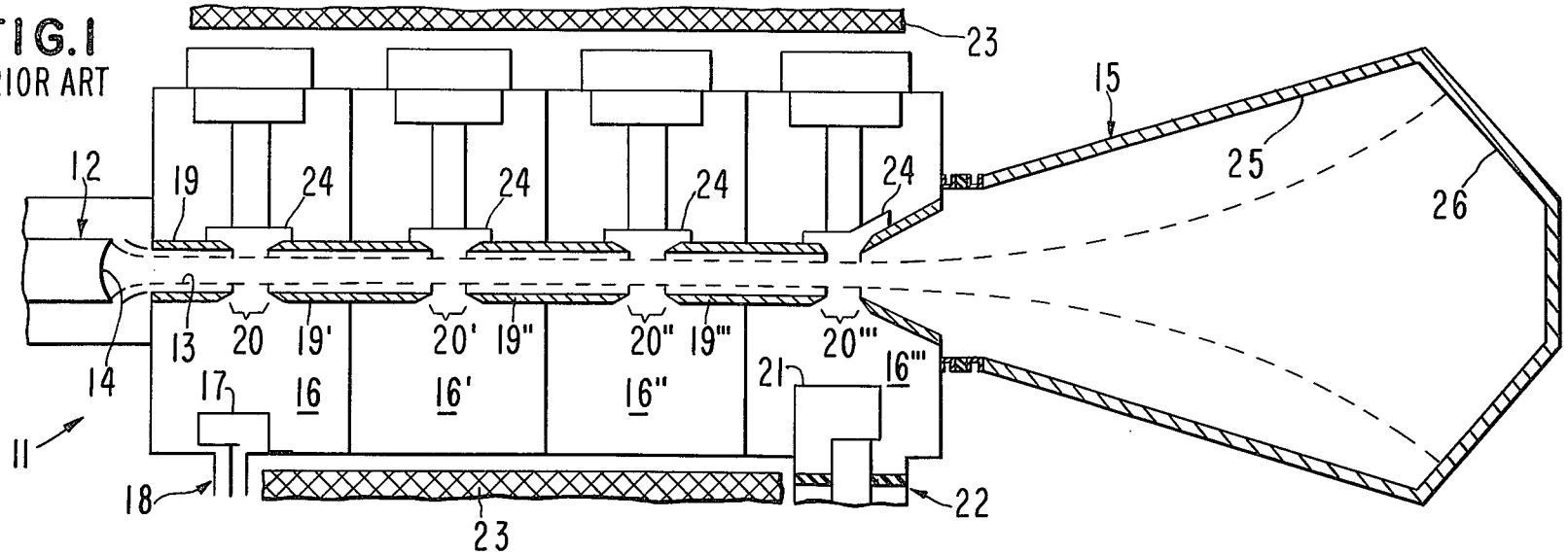
FIG. 1 PRIOR ART
FIG. 1 is a cross sectional view partly in schematic line diagram form of a prior art UHF multicavity klystron amplifier.

FIG. 1 shows one type of prior art UHF multicavity klystron amplfier 11 which includes a conventional electron gun assembly 12 for forming and projecting a beam of electrons 13 over an elongated beam path to a beam collector assembly 15. A plurality of cavity resonators 16–16''', successively arranged along the beam path, together form a wave-beam interaction circuit for electromagnetic interaction with the beam 13.

An imput signal to be amplified is fed into the input cavity resonator 16 via input coupling loop assembly 17 and input coaxial line 18. Drift tube tunnels 19–19''' through which beam 13 passes, communicate between successive cavity resonators 16–16'''. The mutually opposed ends of the drift tube tunnels, projecting into each of the cavity resonators 16–16''' define electronic interaction gaps 20–20'''.

The signal in input cavity resonator 16 excites resonance of that cavity, developing an alternating electric field across input gap 20. The electric field in gap 20 velocity modulates the beam 13. In the suceeding drift tube tunnel 19' this velocity modulation is converted within the drift space to current density modulation which excites resonance of the next two cavities 16' and 16''. These two succeeding cavities act as driver cavities to further velocity modulate the beam 13, which velocity modulation is converted in drift tube tunnels 19'' and 19''', respectively, into increased current density modulation of the beam 13 as the electrons move toward the collector 15.

In the output cabity resonator 16''', the accumulated current density modulation of beam 13 produces an amplified output signal which is extracted by means of output coupling loop 21. This output signal is then fed to a suitable load such as a transmitting antenna, not shown, via output coaxial line 22. A solenoid 23 surrounds tube 11 to provide an axial magnetic field which confines the electrons of the beam to the desired beam path. Capacitive tuning plates 24 bridge the gaps 20–20''' within cavities 16–16''', respectively, for mechanically tuning the operating frequency of the tube within a desired range of frequencies such as, for example, 470 MHz to 560 MHz.

In a typical example of a prior art tube according to FIG. 1, the electron gun 12 produced a beam 13 of 4.8 amperes at a beam voltage of 18 kv. with a beam perveance of $2\times10^{-6}$. The cathode emitter 14 had an emission density of 0.8 ampere per square centimeter of emitting surface. The cavities 16–16''' were cylindrical with an inside diameter of 8 inches and a length of 5.4 inches. Drift tube tunnels 19–19''' were of copper and had an internal diameter of 0.875 inch and an outside diameter of 1.475 inches.

The collector 15, shown in somewhat simplified form, was made of copper and had a shape conforming to that of the expanding beam of primary electrons 13 within the collector region. Collector 15 is insulatedly mounted on the main body of tube 11 and would typically be operated at ground (0 volts) potential, and would be provided with a liquid cooling means (not shown) surrounding its exterior surface.

Since the collector region comprises a virtually electric-field-free space having only a very low value of magnetic leakage field strength, the beam 13 rapidly diverges upon entering the collector region under the influence of its internal space charge forces. Accordingly as shown collector 15 has a similar expanding a diverging shape such that the primary beam of electrons does not impact the axially extending side wall portions 25, but does strike an enlarged surface portion 26 which forms the end wall of the collector 15. In accordance with the teachings of the aforecited U.S. Pat. No. 3,806,755, impact surface portion 26 is dimensioned sufficiently large to receive all of the primary beam electrons under normal operating conditions of the tube, and has a shape approximating that of a portion of a sphere having its center at the entrance to the collector.

While the prior art collector design represented in simplified form in FIG. 1 was largely successful in achieving a significant reduction in the number of secondary electrons returning from the collector to the interaction sections of the tube, and in minimizing any modulation in the quantity or amplittude of these returning secondaries, it was still necessary to coat the walls of the collector with carbon in order to further reduce the quantity of secondary electrons to an acceptable figure. Since, as already noted, the carbon coatings gave rise to problems of outgasing and contamination of the vacuum within the tube, a means of eliminating these coatings was considered desirable.

Figure 2:
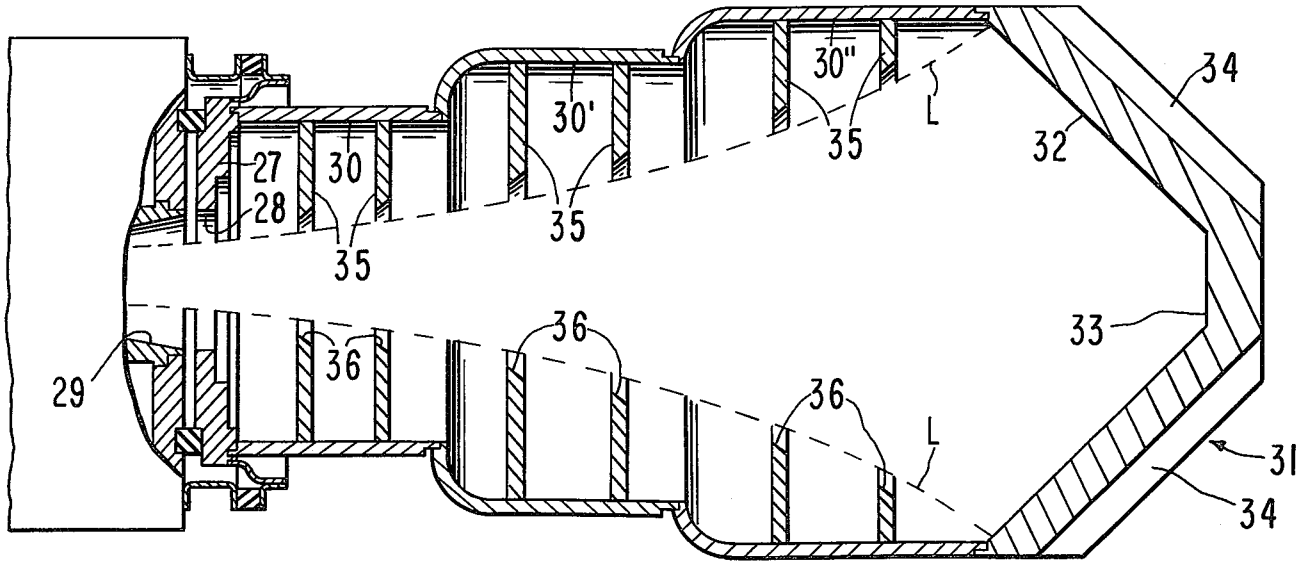
FIG. 2 is an enlarged detailed view of an electron collector illustrating the principles of the present invention.

FIG. 2 illustrates the improved collector design according to the present invention. The collector comprises a front plate 27 which is insulated from and vacuum-tightly joined to the body of tube 11 and defines a constricted entrance apertures 28 in coaxial registration with a tapered output 29 of the tube 11. To the downstream face of front plate 27 are joined in succession a series of three substantially cylindrical ring body members 30–30''. An end wall assembly 31 closes the downstream end of member 30''. End wall assembly 31 is comprised of a peripheral portion 32 which is substantially a right truncated section of a circular cone, and a circular flat end section 33. End wall assembly 31 and ring body members 30–30'' are dimensioned such that under conditions of the maximum beam divergence which is anticipated in the collector, indicated by limiting lines L, all of the electrons of the beam will nevertheless impact upon end wall assembly 31. In simple terms this means that the further assembly 31 is positioned from constricted entrance aperture 28, the larger assembly 31 must be.

Also according to the aforecited U.S. Pat. No. 3,806,755 all of the points on end wall assembly 24 should, insofar as practical, lie on the locus of points equidistant from the center of the midplane of the constricted entrance aperture 28 of the collector. Such a locus of points is, of course, a portion of a sphere having its center at the center of the midplane of constricted entrance aperture 28. In practice however, considerations of the cost of machining and the desirability of providing a set of cooling fins 34 on the external surface of end wall assembly 31 have dictated the just-described and illustrated shape which deviates from the ideal locus of points by up to 15 percent.

While the collector design of FIG. 2 as described up to this point had satisfactory performance when the internal surfaces thereof were coated with carbon, for reasons already noted it was considered desirable to eliminate the carbon coating. In accordance with the present invention the internal carbon coating can be eliminated while preserving good performance with respect to suppression of secondary electrons by providing a series of baffle plates 35 axially spaced along the internal surfaces of ring body members 30–30″. Each of these baffle plates 35 is provided with an internal aperture 36 cut at a beveled angle such that the inner surface of each aperture 36 faces somewhat towards end wall assembly 31. Members 27, 30–30″, 31 and 35 may be made of oxygen-free high conductivity copper brazed together at all joints.

In use the baffle plates 35 have proven to be as effective in reducing observed currents of secondary electrons as were the carbon coatings used in prior art tubes. Factors of reduction on the order of three or more in the observed current of secondary electrons in the tube have been noted.

The mechanism by which baffle plates 35 produce such a reduction in secondary electrons entering the tube body is not clearly understood. Two theories have emerged, both relying on the fact that the baffle plates 35 limit the region of space in the collector through which emitted electrons can travel back into the tube.

One theory is that high speed secondary electrons emitted from end wall assembly 34 in the absence of baffle plates 35 strike the inner surface portions of ring body members 30–30″ causing the emission of tertiary or third generation electrons at the right angle and velocity to enter constricted entrance aperture 28 and return down the tube. With baffle plates 35 in place these tertiary electrons would be emitted in a direction toward end wall assembly 34 whence they could not escape from the collector region.

A second theory is based upon the fact that secondaries emitted from end wall assembly 34 must in general make their way to costricted entrance aperture 28 along a path different from that of the primary electrons which generated them. This is true because, in their travel toward the mouth of the collector, these secondaries are subjected to electric fields generated by the high density beam of electrons. These fields vary in time according to the radio frequency of the tube such that the secondary electrons do not experience the same electric field in their transit toward the entrance of the collector as did the primary electrons which generated them. Therefore the secondary electrons in order to pass through constricted entrance aperture 28 must follow trajectories which are different from those of the primary beam electrons. If a series of baffle plates 35 is interposed in the path of most trajectories other than those of the primary beam electrons, most of the secondaries cannot escape from the collector and will impact upon the baffle plates 35.

Many changes could be made in the above construction and many apparently widely different embodiments of this invention could be made without departing from the scope thereof. For example the axially extending wall of the collector, corresponding to ring members 30–30″ in FIG. 2, could closely approach the perimeter of the electron beam throughout the collector region. Furthermore ring members 30–30″ could have internal diameters chosen such that they closely approach the perimeter of the beam at both the upstream and downstream end of each member 30–30″. Finally, the baffles need not be flat plates, but could be cones or curved cups of various shapes. Therefore, it is intended that all matter contained in the above description or shown in the accompanying drawings shall be interpreted as illustrative and not in a limiting sense.

What is claimed is:

1. A linear beam electron discharge device dimensioned to operate under preselected parameters of voltage, fields and frequencies comprising: electron gun means for forming and projecting a beam of electrons over an elongated path extending from an upstream end of said device, wave beam interaction circuit means axially coextensive with and adjacent to a portion of said beam path for velocity modulating said beam at said preselected frequencies, means for extracting an output radio frequency signal from said velocity modulated beam at the downstream end of said device, hollow collector means within which said beam expands in transverse cross section in the downstream direction, the inner surfaces of said collector means being dimesnioned with respect to the shape of said expanding cross sections when said device is operated under said parameters, said inner surfaces of said collector means comprising, at the upstream end thereof, a constricted entrance portion dimensioned to allow passage of said beam therethrough; at the downstream end thereof, an electron impact portion dimensioned to intercept substantially all of said beam and dissipate its energy; and between said entrance portion and said impact surface portion, and electrically conductive wall portion dimensioned to surround said beam; said wall portion comprising outer transverse cross sections substantially outside said beam, said wall portion further comprising a plurality of baffle members spaced along the direction of said beam, said baffle members extending inwardly from said outer transverse cross sections to define apertures with peripheries outside said beam.

2. The apparatus of claim 1 wherein said impact surface portion of said collector deviates from the locus of points equidistant from the center of the midplane of said constricted entrance portion by less than 15 percent.

3. The apparatus of claim 1 wherein said beam has an axis and wherein said baffles are axially spaced and extend radially inward transverse to said axis and wherein said apertures are circular, having increasing diameter in a downstream direction.

4. The apparatus of claim 3 wherein the edges of the central aperture in said conductive sheets are beveled in a direction to cause them to face toward said impact surface portion.

5. The apparatus of claim 3 wherein said baffles are annular discs of copper electrically and thermally joined to said outer transverse sections of said wall portion.

* * * * *

UNITED STATES PATENT AND TRADEMARK OFFICE

CERTIFICATE OF CORRECTION

PATENT NO. : 3,936,695

DATED : February 3, 1976

INVENTOR(S) : Robert C. Schmidt

It is certified that error appears in the above-identified patent and that said Letters Patent are hereby corrected as shown below:

Column 1 - Line 41
"material" should read -- materials --

Column 2 - Line 7
"of" (first occurrence) should read -- at --

Column 2 - Line 20
"the" should read -- in --

Column 3 - Line 40
"cabity" should read -- cavity --

Column 3 - Lines 48-49
"20-20''' " divided in middle of number

Column 4 - Line 8
"a" (second occurrence) should read -- or --

Column 4 - Line 10
"impact the" should read -- impact upon the --

Column 4 - Line 11
"surface" should read -- impact surface --

Column 4 - Line 25
"amplittude" should read -- amplitude --

Column 4 - Line 37
"apertures" should read -- aperture --

Column 4 - Line 38
"output 29" should read -- output drift tube tunnel 29 --

UNITED STATES PATENT AND TRADEMARK OFFICE

CERTIFICATE OF CORRECTION

PATENT NO. : 3,936,695

DATED : February 3, 1976

INVENTOR(S) : Robert C. Schmidt

It is certified that error appears in the above-identified patent and that said Letters Patent are hereby corrected as shown below:

Column 5 - Line 40
"costricted" should read -- constricted --

Column 6 - Line 27
"dimesmioned" should read -- dimensioned --

Column 6 - Line 54

"diameter" should read -- diameters --

Signed and Sealed this twentieth Day of April 1976

[SEAL]

*Attest:*

RUTH C. MASON
*Attesting Officer*

C. MARSHALL DANN
*Commissioner of Patents and Trademarks*